US005352129A

United States Patent [19]

Guglhör

[11] Patent Number: 5,352,129

[45] Date of Patent: Oct. 4, 1994

[54] ACTIVATOR PLUG

[75] Inventor: Bernhard Guglhör, Buching, Fed. Rep. of Germany

[73] Assignee: Bernhard Guglhor Prazisionsteile GmbH & Co., Fed. Rep. of Germany

[21] Appl. No.: 11,884

[22] Filed: Feb. 1, 1993

[30] Foreign Application Priority Data

Feb. 5, 1992 [DE] Fed. Rep. of Germany ..... 4203239

[51] Int. Cl.[5] ..... H01R 13/703

[52] U.S. Cl. ..... 439/188; 439/852

[58] Field of Search ..... 439/188, 852, 842, 843, 439/845, 850, 851

[56] References Cited

U.S. PATENT DOCUMENTS 3,976,850 8/1976 Faber et al. ..... 439/188
4,087,151 5/1978 Robert et al. ..... 439/188
4,358,135 9/1982 Tsuge et al. ..... 439/188
4,514,030 4/1985 Triner et al. ..... 439/188
4,904,196 2/1990 Sueyoshi et al. ..... 439/188

*Primary Examiner*—Larry I. Schwartz
*Assistant Examiner*—Hien D. Vu
*Attorney, Agent, or Firm*—Reese Taylor

[57] ABSTRACT

An activator plug for a power strip connector to printed wiring board circuits, particularly to data bus boards, having a plurality of sockets for receiving a contact strip containing a blade-contact connector contains at least two contact elements assigned to sockets, which form a shorting bridge between the sockets as long as the blade contact is plugged in, and the insertion of the blade-contact connector and therefore the spreading of the elements receiving the blade contacts lead to an interruption in the shorting bridge. The shorting bridge is produced by means of a direct contact between the sockets or via a contact insert admitted into the base body that bears the contact strip.

3 Claims, 4 Drawing Sheets

ACTIVATOR PLUG

The present invention relates to an activator plug for a power strip connector of electrical circuits, particularly of data bus boards, for controlling machines, wherein the power strip connector comprises a contact strip for receiving the contact blade of a blade-contact connector.

BACKGROUND OF THE INVENTION

Data bus boards are functional elements in circuits of electronic data processing that control the transmission of data between individual circuit components such as microprocessors and input or output elements. In electronically-controlled machines, it is necessary, depending on the specific use of the controlled machine, to adapt universally applicable data bus boards to the machine components to be triggered and, in doing this, to open, close or short-circuit data channels inside the data bus board, depending on the concrete requirements of the circuitry.

In a number of applications, it occurs that certain circuit elements of the data bus board are to be short-circuited as soon as an external control component has been decoupled by means of removal of the typically used power strip connector. This short-circuit could be realized up to now by blade-contact connectors, for example, which are used in place of the power strip connector that makes the connection of the external control components to the board, and that contain shorting links between the individual blade contacts.

OBJECT AND SUMMARY OF THE INVENTION

The object of the present invention is to recite an activator plug for a power strip connector of electronic circuits, particularly for data bus boards, that automatically forms a shorting bridge between at least two extensions of the electronic circuit as soon as the blade-contact connector, which correspondingly makes a connection to an external control component, for example, is removed.

This object is attained in accordance with the characterizing features of the main claim in that the sockets contained in the contact strip belonging to the power strip connector are provided with resilient contact elements that form a shorting bridge between the sockets, and are spread apart by the insertion of the blade-contact connector such that the bridge between the sockets is interrupted.

The subject of the invention is explained below by means of the drawings.

BRIEF DESCRIPTION OF THE PREFERRED EMBODIMENTS

Figure 1:
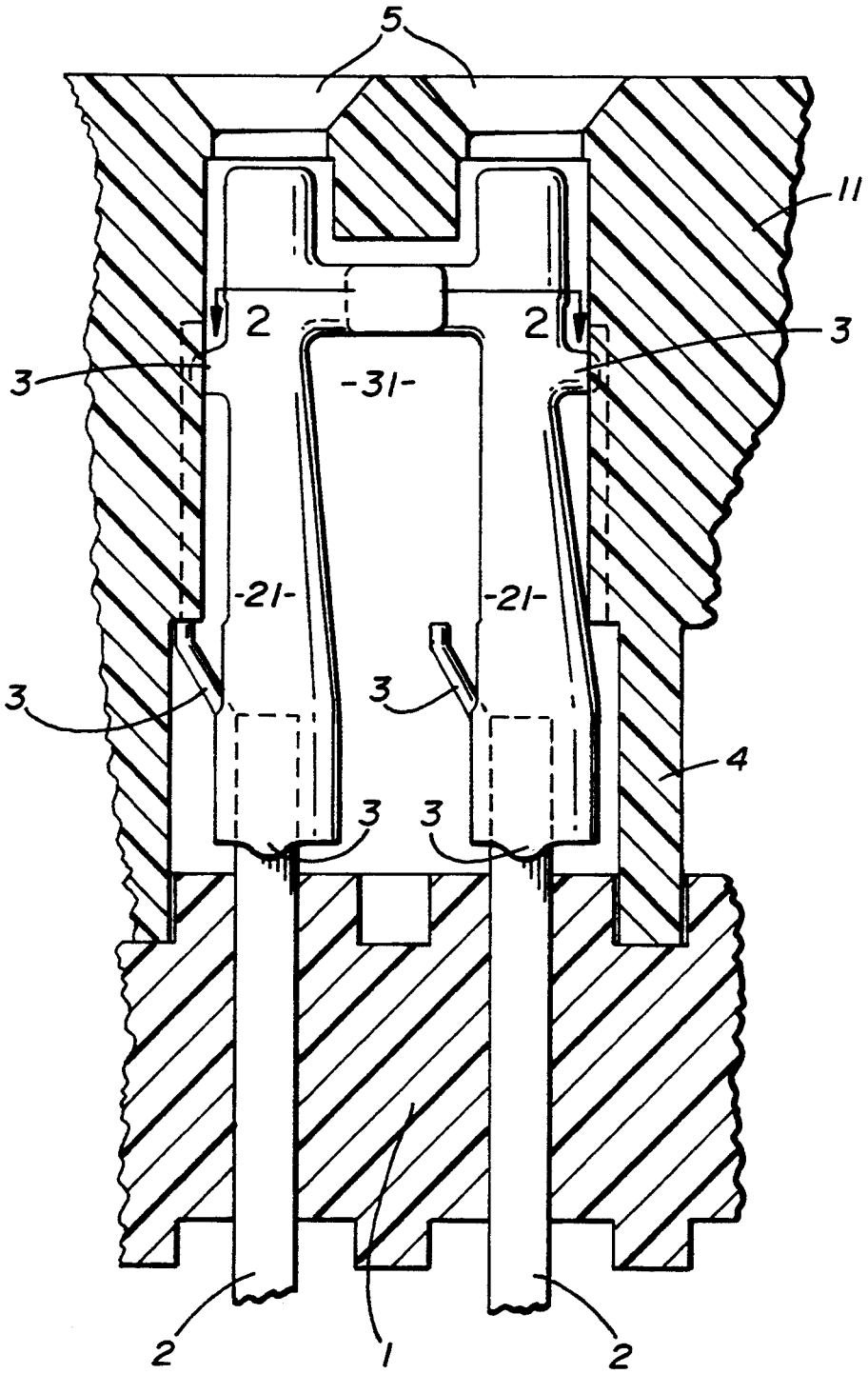
FIG. 1*a* shows the side view of a section of a plug connector of an activator plug in accordance with a first exemplary embodiment of the present invention.
FIG. 1*b* shows a section along the A-B line shown in FIG. 1*a;*

In FIG. 1*a*, the side view of a plug connector is shown in section to correspond to the standard DIN 41612. The power strip body 1 receives the rigid contact pins 2 leading to the external extension. The contact pins 2 are electrically connected to the socket 21 set in the base body 11. The plastic base body 11 is disposed on the power strip body 1 with support elements 4. The support and guiding elements 3 correspond to the known functional elements for securing the sockets 21 which, through the funnel-shaped openings 5, receive the blade contacts (not shown) for connection with an external circuit. A plug connector corresponding to the sectional representation is usually equipped with 96 contacts.

In FIG. 1*b* (section along the A-B line in FIG. 1*a*), the sockets 21 have a U-shaped profile in the longitudinal direction, on the bottom of which a pair of resilient elements 211, 212 that serves in the resilient reception of the plugged-in blade contacts, is attached in the area of the impressing zone, beneath the funnel-shaped opening 5. Corresponding to the shown exemplary embodiment of the activator plug in accordance with the invention, respectively, one leaf 211 of the resilient elements 211, 212 is lengthened by means of the formation of circuit lugs 41 in such a way that the circuit lugs overlap in the area between the impressing zones of the two sockets. Thus, the contact elements 31 described in the main claim are formed by the resilient elements 211, 212 and the circuit lugs 41.

The circuit lugs 41 are pressed apart by the insertion of the blade contact between the resilient elements 211, 212, so that no electrical contact can be made between them as long as the blade-contact connector is plugged in. As soon as the resilient elements 211, 212 are relieved of the spreading blade contact, the circuit lugs 41, as shown in FIG. 1*b*, come into contact with one another, by means of which a shorting bridge is formed between the adjacent sockets.

Figure 2:
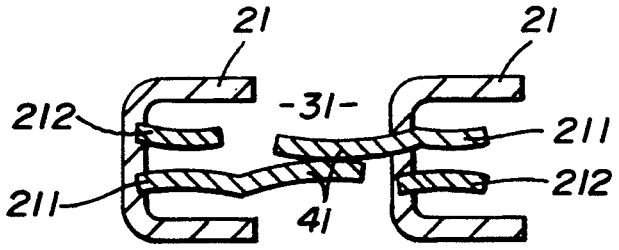
FIG. 2*a* shows the side view of a section of the contact strip of a plug connector in accordance with a second exemplary embodiment of the present invention.
FIG. 2*b* shows a sectional representation along the A-B line in FIG. 2*a*.
FIG. 2*c* shows a sectional representation along the C-D line in FIG. 2*a*.
Figure 3:
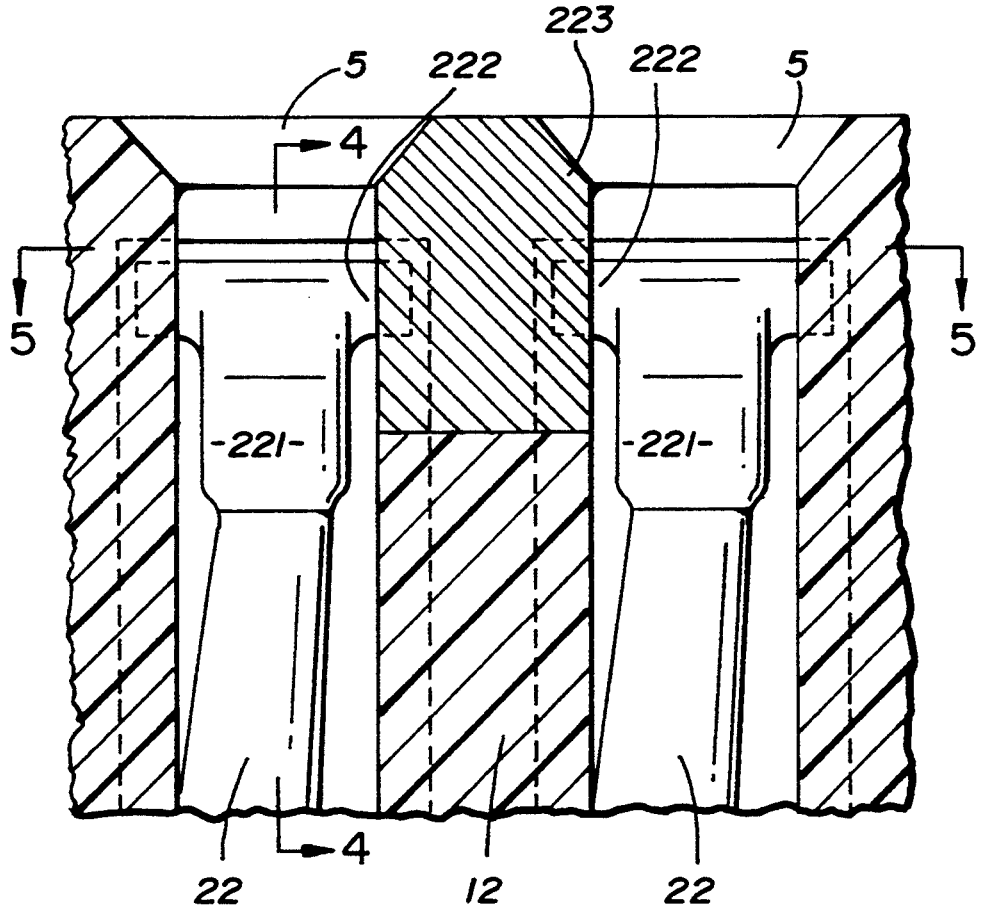
Figure 4:
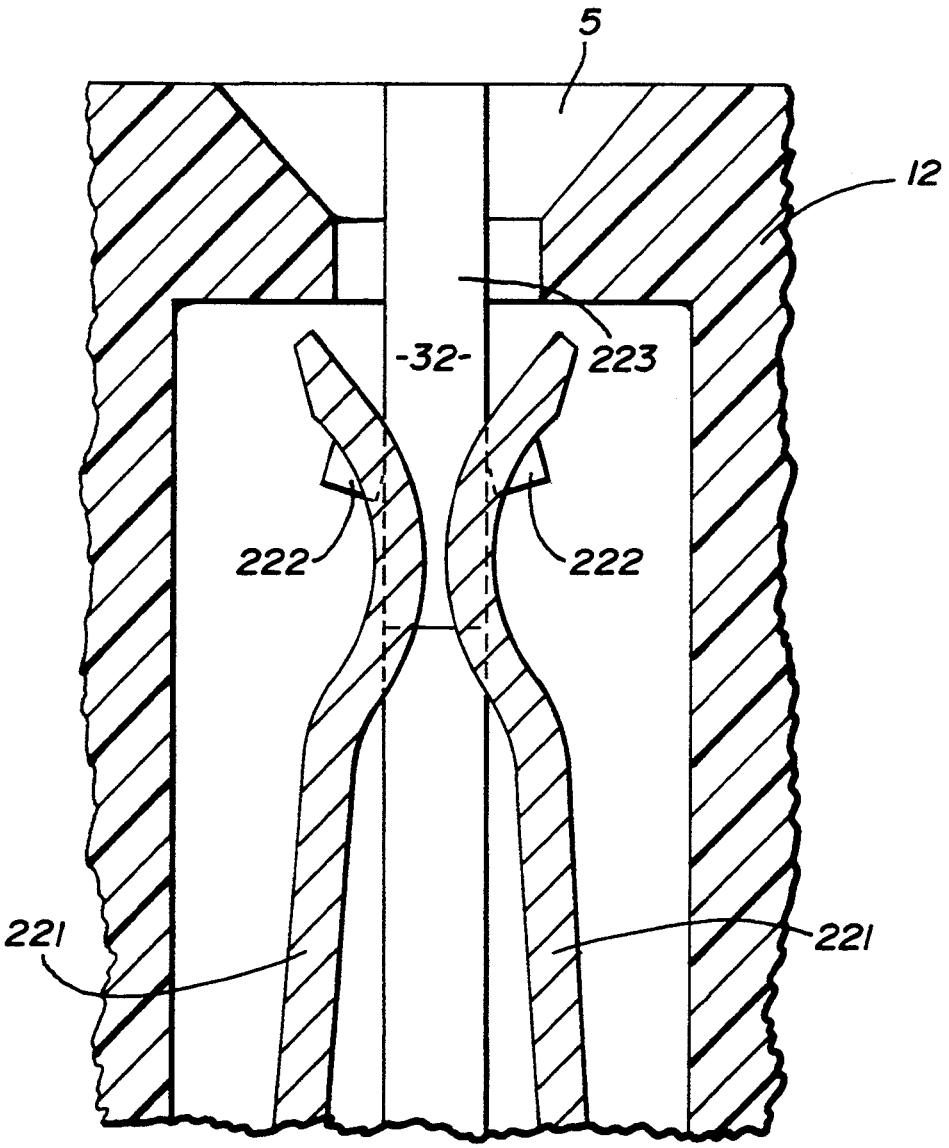
Figure 5:
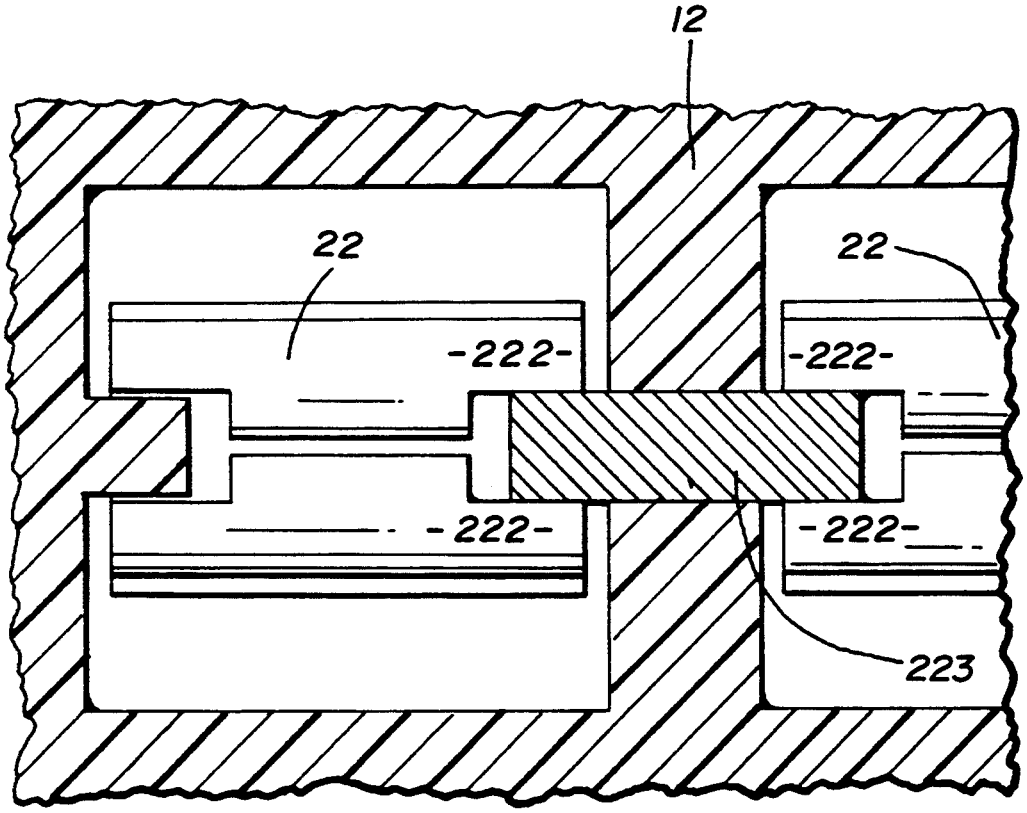

Corresponding to the exemplary embodiment of the activator plug in accordance with the invention shown in FIGS. 2*a*–2*c*, the sockets 22 for connecting the plugged-in contact blades to the contact pins of the printed wiring board (not shown) are formed by means of the strip-like legs 221 attached in a resilient manner, which have an S-shaped curve in their head area to receive the contact blade. Moreover, the sockets 22 are widened in their head area by the circuit lugs 222. These circuit lugs protrude in the direction of the adjacent socket over a metallic contact insert 223 attached between the sockets in the isolating housing, and, in the case of sockets 22 spread apart by an inserted blade contact, the circuit lugs 222 are bent away in such a way that no electrical contact can be made between them. If the blade contact is removed, however, the contact between the circuit lugs 222 and the contact insert 223 closes, so that the shorting bridge between the adjacent sockets is formed.

The activator plug in accordance with the second exemplary embodiment can be modified according to the desired properties of the circuit connection such that, for certain socket pairs, the contact inserts 223 are removed from the base body in order to prevent the formation of a shorting bridge, if need be.

The contacting of two adjacent sockets shown by means of the exemplary embodiments can, in principle, also be applied generally to a plurality of sockets. In addition, the application of the circuit element in accordance with the invention is also possible with contact strips that only contain one socket pair.

What is claimed is:

1. An activator plug for a power strip connector of printed circuit board circuits of electronic components that comprises a number of laterally adjacent metallic sockets fastened on an insulating base body for the resilient reception of a blade contact connector, comprising at least two resilient contact elements for each socket having protruding circuit lugs extending therefrom to engage with a contact insert for normally producing an electrically conductive connection between the sockets; and said resilient contact elements being separable from said contact insert upon insertion of the blade contact connector into the socket to interrupt the electrically conductive connection.

2. The activator plug as defined by claim 1, characterized in that the insulating base body (12) contains metallic contact inserts (223) in the area of the impressing zones of the sockets to be connected, and that each socket (22) includes two strip-like legs (221) attached in a resilient manner that make the electrical connection between the blade contact and a contact pin of the circuit board when the blade contact connector is inserted.

3. The activator plug as defined by claim 2 characterized in that the contact inserts (223) in the insulating base body (12) of the contact strip are removable.

* * * * *